US006259409B1

(12) United States Patent
Fulton et al.

(10) Patent No.: US 6,259,409 B1
(45) Date of Patent: Jul. 10, 2001

(54) RETRACTABLE SLIDING ANTENNA ASSEMBLY FOR WIRELESS COMMUNICATION

(75) Inventors: Paul Fulton, Los Gatos, CA (US); Thomas A. Johnson, Draper, UT (US); Tim Urry Price; Steven C. Aldous, both of Salt Lake City, UT (US); Carlos A. Rios, Los Gatos, CA (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/359,990

(22) Filed: Jul. 22, 1999

(51) Int. Cl.[7] ..... H01Q 1/24

(52) U.S. Cl. ..... 343/702; 455/90; 455/128; 455/348

(58) Field of Search ..... 343/702, 700 MS, 343/793, 820, 850, 880; 455/90, 128, 348

(56) References Cited

U.S. PATENT DOCUMENTS 5,138,328 * 8/1992 Zibrik et al. ..... 343/702
5,300,938 * 4/1994 Maroun et al. ..... 343/702
5,337,061 * 8/1994 Pye et al. ..... 343/702
5,357,091 * 10/1994 Ozawa et al. ..... 235/380
5,361,061 * 11/1994 Mays et al. ..... 343/702
5,563,400 * 10/1996 LeRoux ..... 235/486
5,918,163 * 6/1999 Rossi ..... 343/702
6,097,934 * 8/2000 Spall et al. ..... 343/702
6,104,350 * 8/2000 Ng et al. ..... 343/702
6,107,971 * 8/2000 Flegeo ..... 343/702

* cited by examiner

*Primary Examiner*—Don Wong
*Assistant Examiner*—Thuy Vinh Tran
(74) *Attorney, Agent, or Firm*—Wagner, Murabito & Hao LLP

(57) ABSTRACT

A method and apparatus is disclosed for wireless communication of a computer with a wireless network or a wireless device. In one embodiment of the present invention, a pc card is configured for insertion into a computer pc card slot. Additionally, a sliding assembly is housed within the pc card. This sliding assembly is operable for sliding into a retracted position and a protruded position. When in the retracted position, the sliding assembly is mostly concealed within the pc card. When in the protruded position, the sliding assembly is partly exposed outside of the pc card. Furthermore, an antenna element is fitted inside the sliding assembly. When the sliding assembly is in retracted position, this antenna element enables wireless communication of a computer with a wireless network or a wireless device.

21 Claims, 17 Drawing Sheets

771

RETRACTABLE SLIDING ANTENNA ASSEMBLY FOR WIRELESS COMMUNICATION

FIELD OF THE INVENTION

The present invention relates generally to wireless communication. More particularly, the present invention relates to enabling a computer to wirelessly communicate with a wireless network and wireless devices.

BACKGROUND

Computer networks have permeated workplaces as an important tool. A computer network offers many advantages not available in the context of a single computer. For example, a computer network such as a Local Area Network (LAN) enables a group of people to share computer resources and to communicate ideas with each other. Moreover, people in different physical locations can work together on projects.

However, a typical network still has many problematic areas needing improvements. One of these problematic areas is the wiring infrastructure supporting the network. Specifically, in creating a network, using physical wires to connect network nodes comes inevitably with several limitations and complications. First, various types of wires exist that are not compatible with each other. As such, additional specialized connectors and network devices are necessary to create the network. Second, the transmission signal quality of the wire decreases as wire length increases. Thus, wire length cannot exceed the set maximum operable distance without transmission signal degradation. These disadvantages of the network wiring infrastructure motivate the creation and development of wireless network technology. An additional motivation for creating and developing wireless network is node mobility. That is, any node within a wireless network need not be placed in a fixed location as long as the node is within communication range of the wireless network.

All in all, by removing the need for wires, a wireless network transcends various physical limitations of physical wires. Moreover, wireless network advantageously offers node mobility.

For any wireless device, an antenna plays a pivotal role in wireless communication with the wireless network or other wireless devices. The antenna is typically attached to a computer such as a lap-top computer acting as a node within the network. Typically, this antenna is used to communicate data with another wireless device or a wireless network such as a wireless LAN.

In one prior art approach, an antenna is attached to a computer for wireless communication with a wireless network or a wireless device. In particular, this prior art approach is illustrated with FIG. 2A. An antenna 210 is shown attached to a computer 205 externally. When in operation, the orientation of antenna 210 is adjusted to achieve at least adequate reception and transmission to a wireless network 200. Specifically, in FIG. 2A, the wireless network 200 is depicted as a LAN 200.

However, this prior art approach created at least three problems. First, the antenna used is prone to damage. Because the entire antenna protrudes outside of the computer, a user can easily bump off the antenna or break the antenna. Second, the antenna is cumbersome to set up for use. The antenna needs to be attached to the computer, then adjusted for orientation that offers at least adequate reception and transmission. Third, the antenna is inconvenient to store. The entire antenna needs to be removed from the computer first before the computer can be fitted inside a typical computer storage case.

In yet another prior art approach, as shown in FIG. 2B, a telescoping antenna 207 is put to use when pulled from a guide 209 of computer 207 and telescoped into an extended position. When not in use, telescoping antenna 214 is entirely folded within guide 209 of computer 207. This prior art approach allows convenient computer storage because the folded antenna 214 does not protrude out of the side of computer 207.

However, this prior approach creates at least three problems. In particular, the telescoped antenna in its extended position is vulnerable to accidental breakage. Also, this antenna is cumbersome to use. It is first pulled out and away from a computer and telescoped. Moreover, the antenna is obstructive to typing. Sometimes, the antenna positioned for acceptable reception and transmission might actually block a user from easily accessing the computer keyboard. As the antenna orientation is adjusted to achieve at least adequate reception and transmission, this antenna might block or obstruct a user from typing on the computer keyboard.

Thus, a need exists for a computer to wirelessly communicate with a wireless network or a wireless device without the computer antenna being prone to breakage. Also, a need exists for a computer to wirelessly communicate with a wireless network or a wireless device without being cumbersome to set up the computer antenna. In addition, a need exists for a computer to wireless communicate with a wireless network without obstructing a user from accessing the computer keyboard. Furthermore, a need exists for conveniently storing a computer having an antenna for wireless communication.

SUMMARY

The present invention advantageously enables a computer to wirelessly communicate with a wireless network or wireless devices without the computer antenna being vulnerable to breakage. Also, the present invention advantageously enables a computer to wirelessly communicate with a wireless network or wireless devices without being cumbersome to set up the computer antenna. In addition, the present invention advantageously enables a computer to wireless communicate with a wireless network or wireless devices without obstructing a user from accessing the computer keyboard. Furthermore, the present invention advantageously enables convenient storage for a computer having an antenna for wireless communication.

Specifically, in one embodiment, the present invention is implemented as a pc card configured for insertion into a computer pc card slot. Additionally, a sliding assembly is housed within the pc card. This sliding assembly is operable for sliding into a retracted position and a protruded position. When in the retracted position, the sliding assembly is completely concealed within the pc card. When in the protruded position, the sliding assembly is partly exposed outside of the pc card. Furthermore, an antenna element is fitted inside the sliding assembly. When the sliding assembly is in the protruded position, this antenna element enables wireless communication of a computer with a wireless network and wireless devices.

In another embodiment, the present invention is implemented for a device acting as a node within a wireless network- without using a pc card configured for insertion into a pc card slot. A sliding assembly is directly housed within the device. This sliding assembly is operable for sliding into a retracted position and a protruded position. When in the retracted position, the sliding assembly is completely concealed within the device. When in the protruded position, the sliding assembly is partly exposed outside of the device. Furthermore, an antenna element is fitted inside the sliding assembly. When the sliding assembly is in the protruded position, this antenna element enables wireless communication of the device with the wireless network or other wireless devices.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
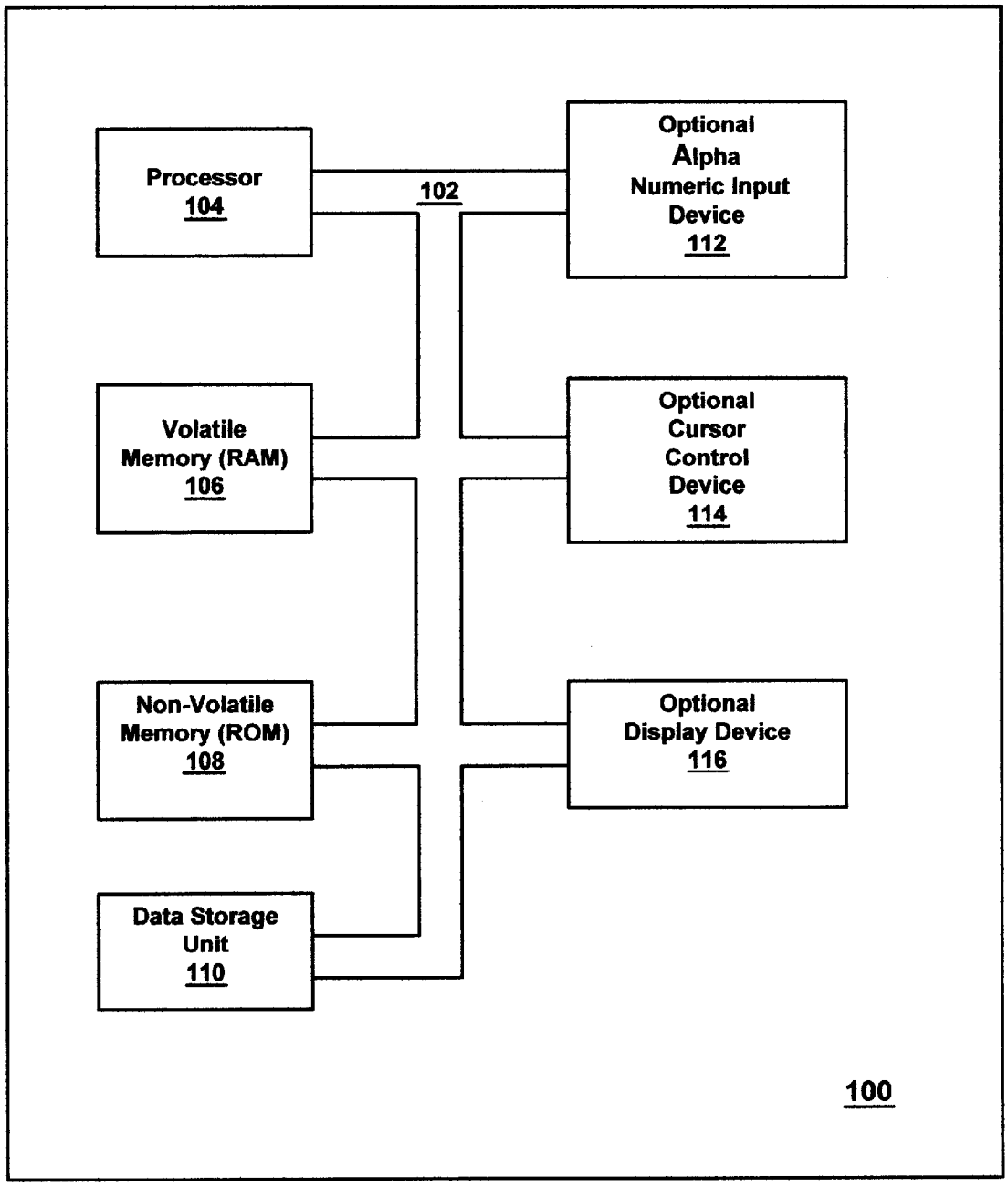
FIG. 1 illustrates a generic computer system for wireless communication with a wireless network or a wireless device.
Figure 2A:
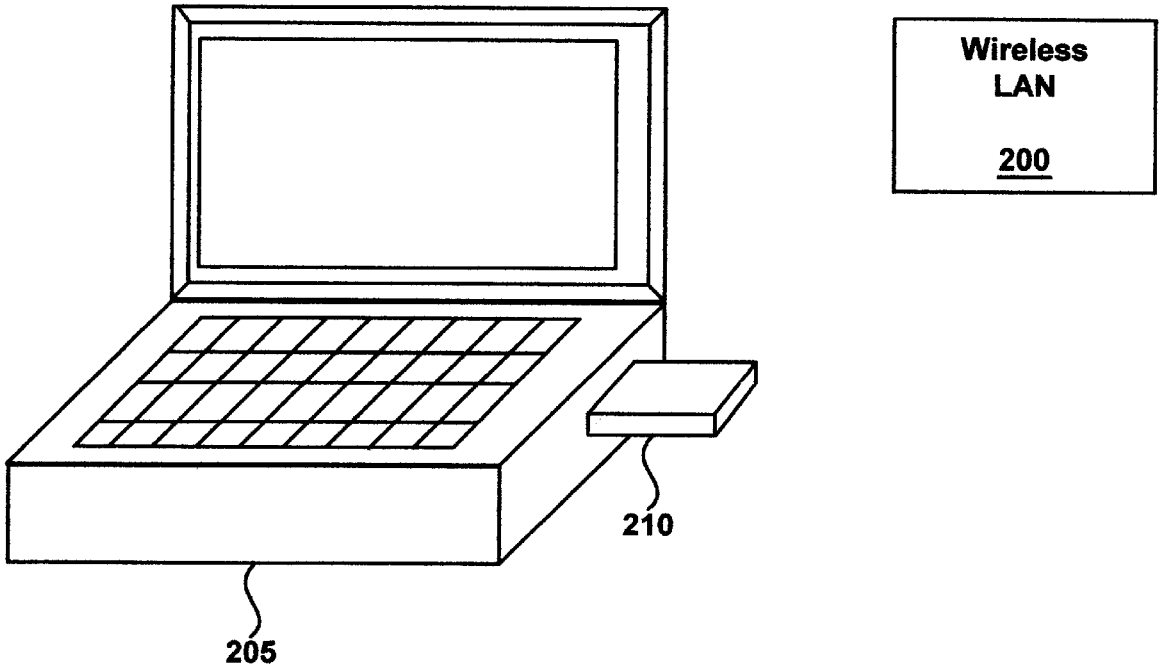
FIG. 2A (Prior Art)
FIG. 2A illustrates one prior art approach for a computer to communicate wirelessly with a wireless network.
Figure 2B:
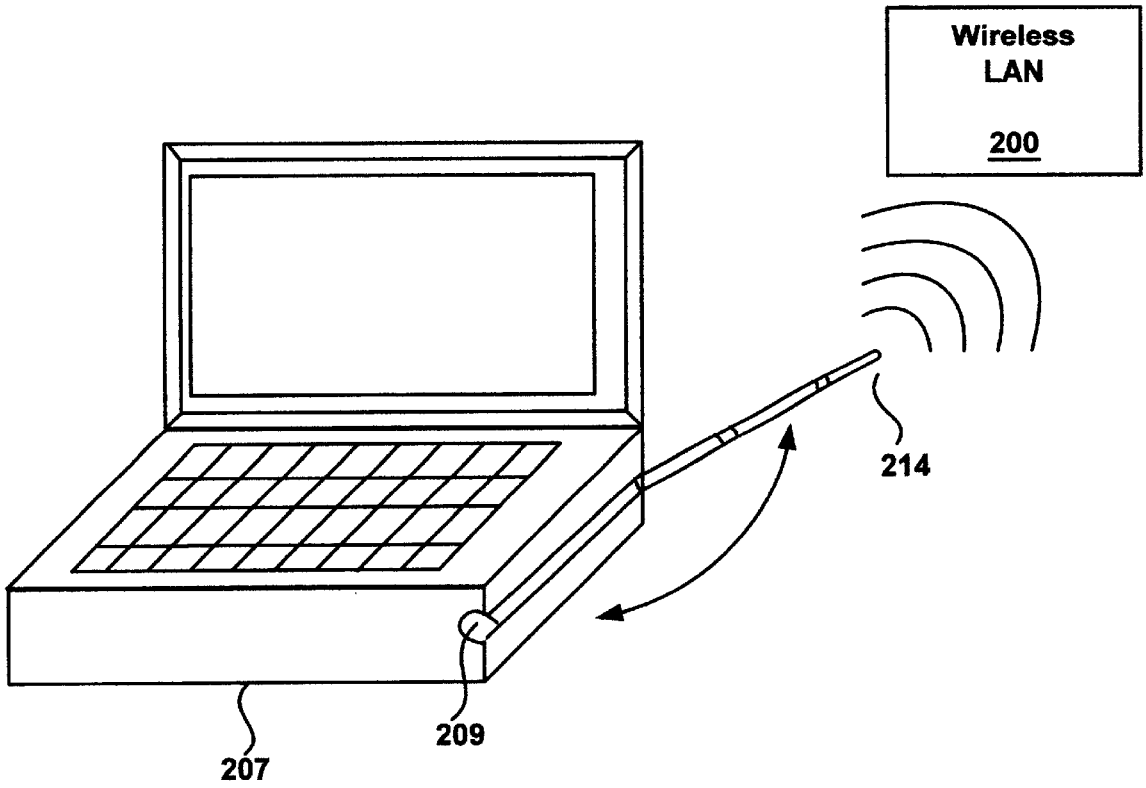
FIG. 2B (Prior Art)
FIG. 2B illustrates another prior art approach for a computer to communicate wirelessly with a wireless network.

Reference will now be made in detail to the preferred embodiments of the invention. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be recognized by one skilled in the art that the present invention may be practiced without these specific details. In other instances, well known methods, procedures, components, and circuits have not been described in detail as to avoid unnecessarily obscuring aspects of the present invention.

Some portions of the detailed descriptions which follow are presented in terms of procedures, logic blocks, processing, and other symbolic representations of operations on data bits within a computer memory. These descriptions and representations are the means used by those skilled in the data processing arts to most effectively convey the substance of their work to others skilled in the art. In the present application, a procedure, logic block, process, etc., is conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proved convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "measuring", "calculating", "receiving", "computing", or the like, refer to the actions and processes of a computer system, or similar electronic computing device. The computer system or similar electronic computing device manipulates and transforms data represented as physical (electronic) quantities within the computer system's registers and memories into other data similarly represented as physical quantities within the computer system memories or registers or other such information storage, transmission, or display devices. The present invention is also well suited to the use of other computer systems such as, for example, optical and mechanical computers.

With reference now to FIG. 1, portions of the present method and system are comprised of computer-readable and computer-executable instructions which reside, for example, in computer-usable media of a computer system. FIG. 1 illustrates an exemplary computer system 100 used in accordance with one embodiment of the present invention. It is appreciated that system 100 of FIG. 1 is exemplary only and that the present invention can operate within a number of different computer systems including general purpose networked computer systems, embedded computer systems, and stand alone computer systems. Additionally, computer system 100 of FIG. 1 is well adapted to having computer readable media such as, for example, a floppy disk, a compact disc, and the like coupled thereto. Such computer readable media is not shown coupled to computer system 100 in FIG. 1 for purposes of clarity.

System 100 of FIG. 1 includes an address/data bus 102 for communicating information, and a central processor unit 104 coupled to bus 102 for processing information and instructions. Central processor unit 104 may be an 80×86-family microprocessor. System 100 also includes data storage features such as a computer usable volatile memory 106, e.g. random access memory (RAM), coupled to bus 102 for storing information and instructions for central processor unit 104, computer usable nonvolatile memory 108, e.g. read only memory (ROM), coupled to bus 102 for storing static information and instructions for the central processor unit 104, and a data storage device 110 (e.g., a magnetic or optical disk and disk drive) coupled to bus 102 for storing information and instructions. System 100 of the present invention also includes an optional alphanumeric input device 112 including alphanumeric and function keys is coupled to bus 102 for communicating information and command selections to central processor unit 104. System 100 also optionally includes a cursor control device 114 coupled to bus 102 for communicating user input information and command selections to central processor unit 104. System 100 of the present embodiment also includes an optional display device 116 coupled to bus 102 for displaying information.

Referring still to FIG. 1, optional display device 116 of FIG. 1, may be a liquid crystal device, cathode ray tube, or other display device suitable for creating graphic images and alphanumeric characters recognizable to a user. Optional cursor control device 114 allows the computer user to dynamically signal the two dimensional movement of a visible symbol (cursor) on a display screen of display device 116. Many implementations of cursor control device 114 are known in the art including a trackball, mouse, touch pad, joystick or special keys on alphanumeric input device 112 capable of signaling movement of a given direction or manner of displacement. Alternatively, it will be appreciated that a cursor can be directed and/or activated via input from alphanumeric input device 112 using special keys and key sequence commands. The present invention is also well suited to directing a cursor by other means such as, for example, voice commands. A more detailed discussion of the embodiments of the present invention are found below.

General Description of the Present Invention

Figure 3A:
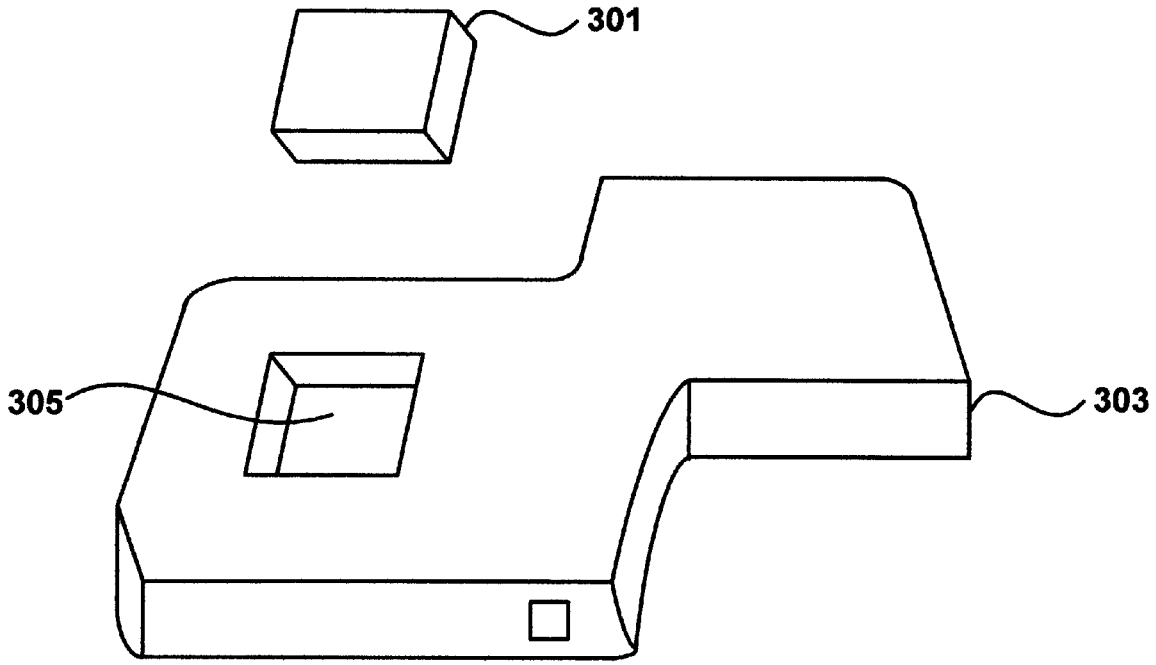
FIG. 3A illustrates an antenna element being fitted within a sliding assembly.
Figure 3B:
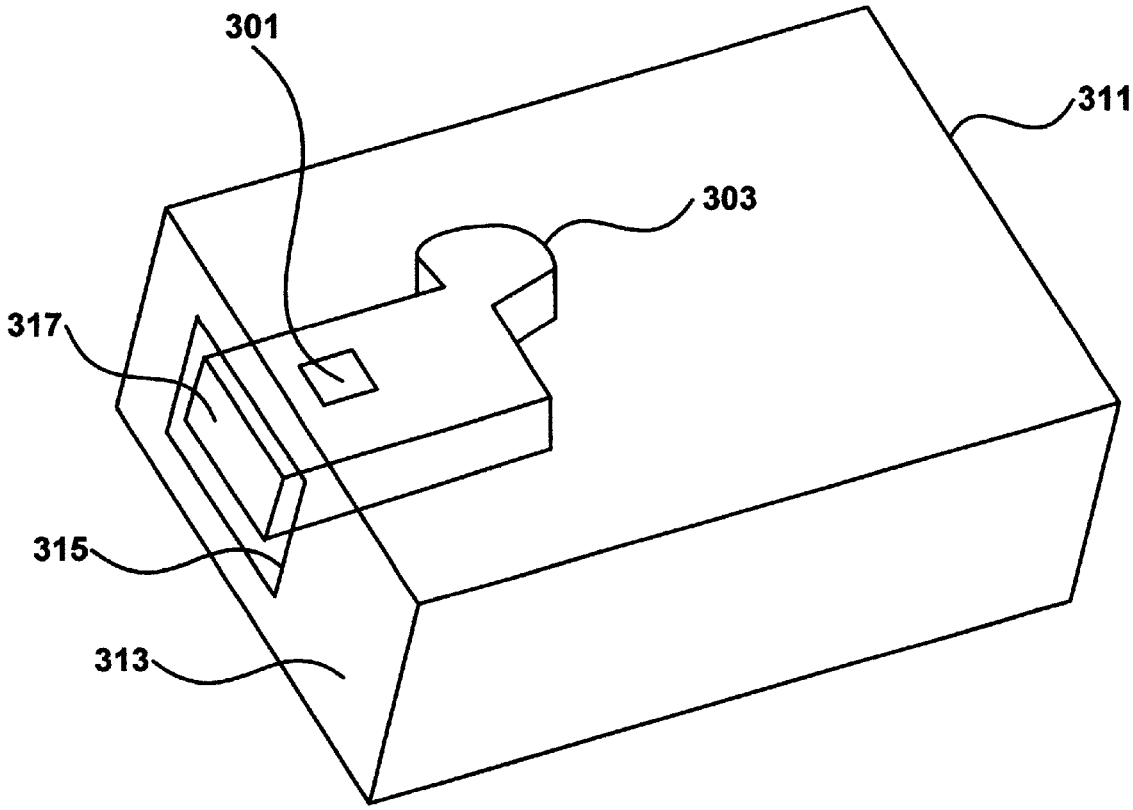
FIG. 3B illustrates the sliding assembly of FIG. 3A as having being housed inside a pc card.
Figure 3C:
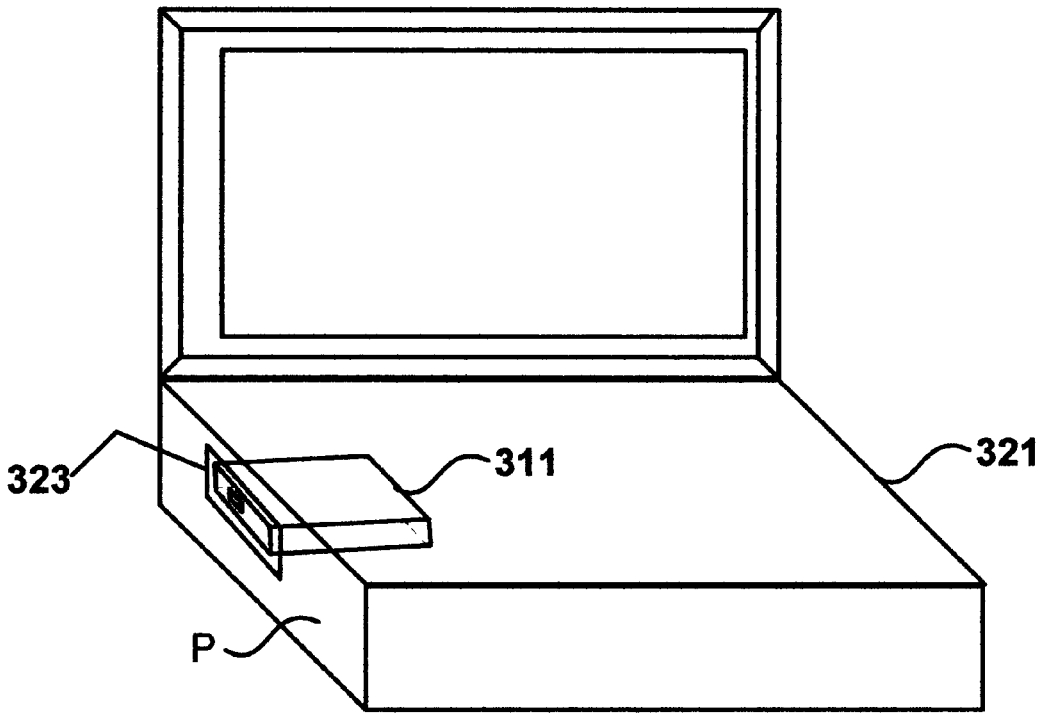
FIG. 3C illustrates the pc card of FIG. 3B as having been inserted into a computer.

FIGS. 3A–C introduce the primary components in one embodiment of the present invention. In particular, FIGS. 3A–B provide the gross overall view of the placement relation among these components, which are an antenna element 301, a sliding assembly 303, a pc card 311 and a computer 321.

With reference now FIG. 3A, a direct placement relation exists between antenna element 301 and sliding assembly 303. Specifically, a rectangular cavity 305 in sliding assembly 303 is configured for containing antenna element 301.

Furthermore, with reference now to FIG. 3B, a direct placement relation exists between sliding assembly 303 and pc card 311. With antenna element 301 is fitted inside cavity 305 of sliding assembly 303, sliding assembly 303 is housed within a pc card slot mouth 315 which opens on a exposing side 313 of pc card 311. As shown, exposing side 313 of pc card 311 is always visible even when pc card 311 is inserted into computer 321. Thus, at least one part of sliding assembly 303- an activation surface 317- will be always visible as well.

With reference now to FIG. 3C, a direct placement relation exists between computer 321 and pc card 311. Generally, pc cards provide various add-on functions for computer 321. As such, these pc cards extend built-in computer functionality. In the present embodiment as shown, pc card 311 is designed specifically to provide wireless communication capability to computer 321, thereby avoiding the overhead of having this capability built-in as a permanent part of computer 321.

In particular, pc card 311 is configured to be inserted into computer pc card slot 323. To receive pc card 311, computer 321 has a pc card slot 323 on side P of computer 321. Moreover, by looking at side P of computer 321, when pc card 311 has been inserted into pc card slot 323, an exposing side 313 of pc card 311 is still visible. Again, as such, sliding assembly 303 is also visible. When pc card 311 has been inserted completely into computer pc card slot 323 as shown, computer 321 is ready to wirelessly communicate with any wireless network and any wireless devices.

The above discussion on FIG. 3A–C pertain mostly to the relative placement relations among various components in one embodiment of the present invention. In FIGS. 4, 5, 6, 7A–B, 8A–B, 9 and 10, other important aspects of these components are discussed in detail.

Antenna Element and Sliding Assembly

Figure 4:
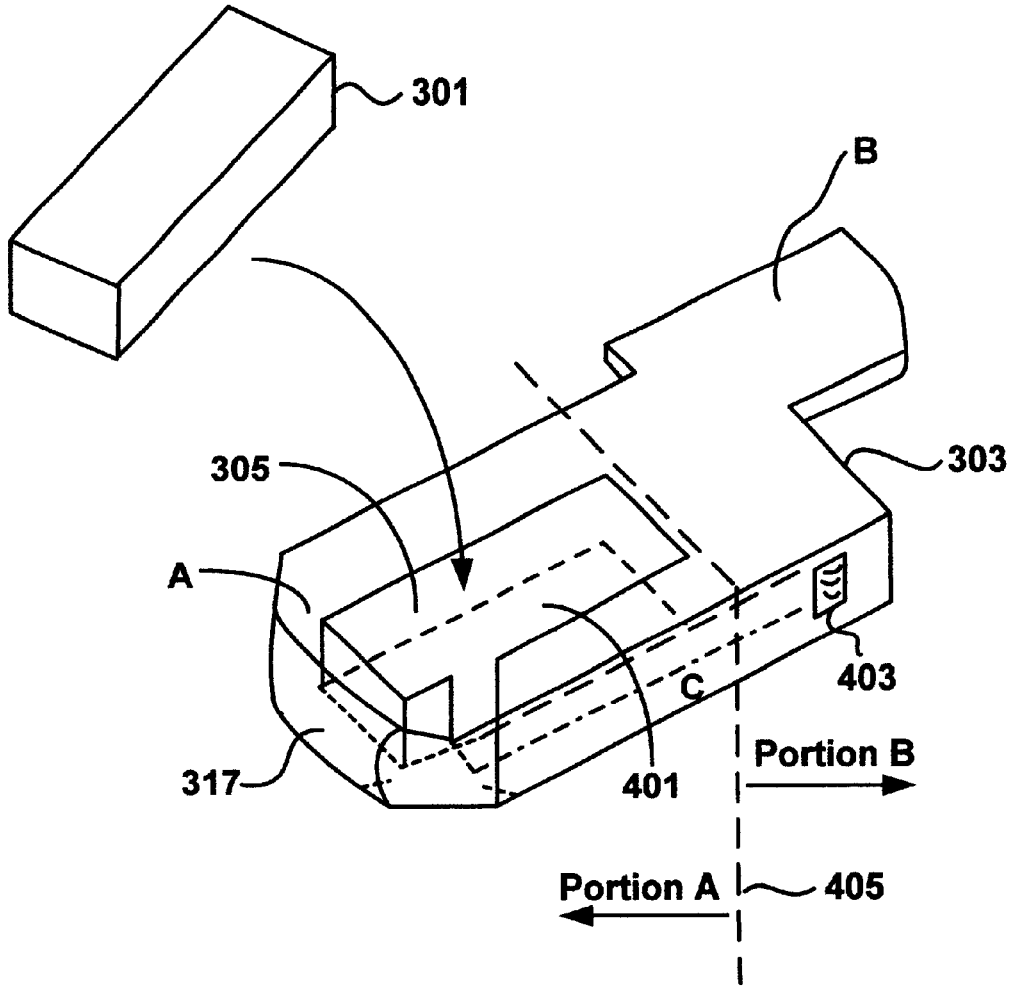
FIG. 4 illustrates one embodiment of a sliding assembly housing an inverted-F antenna element.

With reference now to FIG. 4, antenna element 301 and sliding assembly 303 are illustrated for one particular embodiment. FIG. 4 focuses in on the relationship between sliding assembly 303 and antenna element 301 according to the present embodiment. As shown, antenna element 301 is poised to be fitted inside cavity 305 of sliding assembly 303.

In the present embodiment, the employed antenna element 301 is an inverted-F antenna. That is to say, antenna element 301 uses inverted-F topology. (Inverted-F antenna topology is well known in the art.) In particular, antenna element 301 has radio frequency radiation pattern nearly identical to a mono-/di-pole, but does not require a long antenna to be vertically positioned. In fact, as shown in FIG. 4, antenna element 301 is poised to be mounted horizontally within cavity 305, wholly contained within sliding assembly 303.

With reference still to FIG. 4, a sliding contact 403 of sliding assembly 303 is constructed on side C of sliding assembly 303. In addition, a ground plane 401 is located on the bottom of cavity 305. Moreover, sliding contact 403 is coupled to ground plane 401, which is in turn coupled to antenna element 301. Thus, when antenna element 301 is mounted within cavity 305, electric contact between antenna element 301 and ground plane 401 is made. As such, when antenna element 301 is mounted within cavity 305, an electric circuit is formed by sliding contact 403, ground plane 401 and antenna element 301.

Finally, sliding assembly 303 is classified into two portions separated by a dotted line 405: the frontal portion of sliding assembly 303 designated as portion A, and the rear portion of sliding assembly 303 designated as portion B. As shown, portion A refers to the portion of sliding assembly 303 containing antenna element 301. Moreover, activation surface 317 constitutes part of portion A. Conversely, portion B refers to the other portion of sliding assembly 303 not containing antenna element 301.

Figure 5:
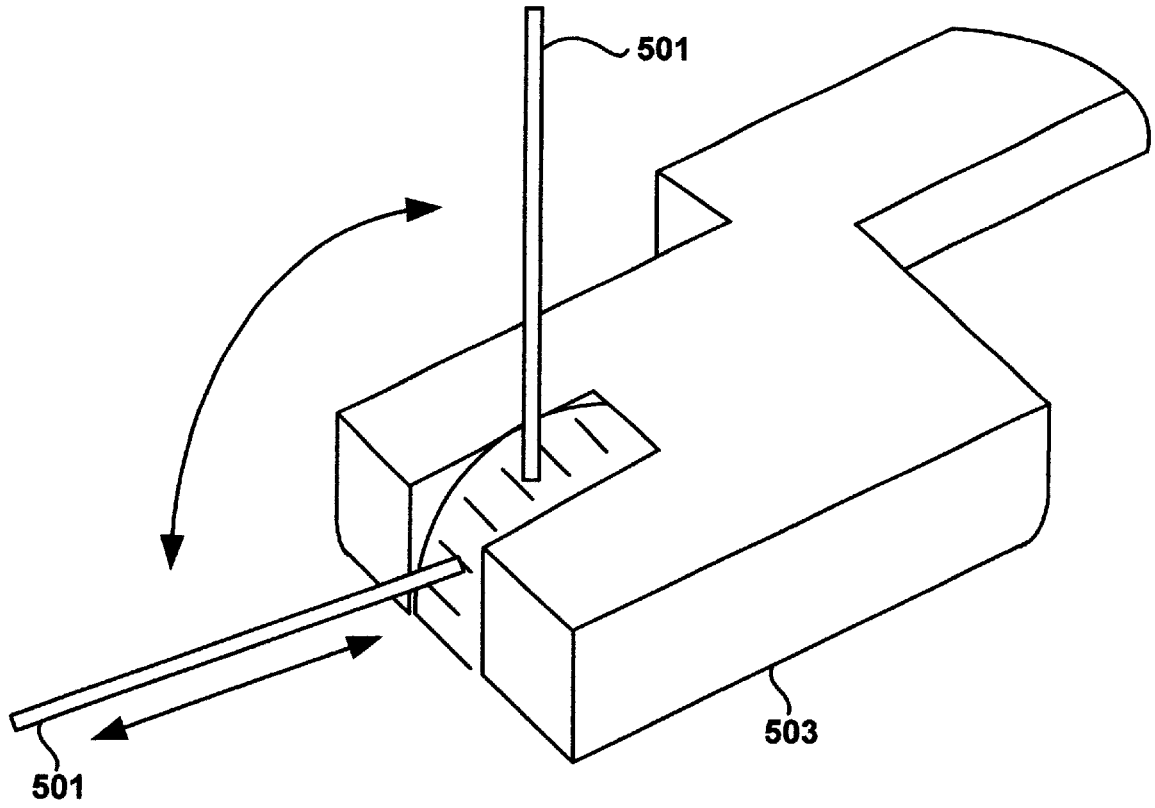
FIG. 5 illustrates one embodiment of a sliding assembly housing a mono-pole antenna element.
Figure 6:
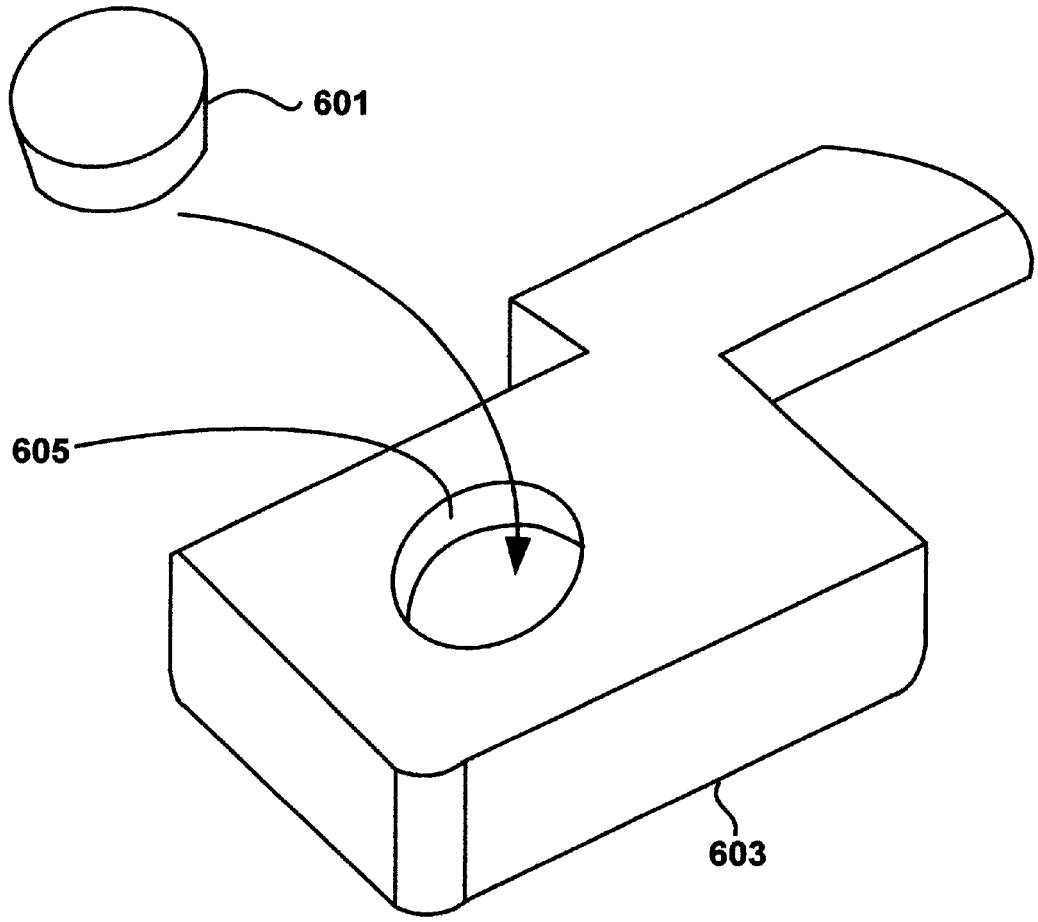
FIG. 6 illustrates one embodiment of a sliding assembly housing a ISM Band Disk antenna element.

Importantly, the type of an antenna element is not restricted to an inverted-F antenna shown in FIG. 4. In some other embodiments monopole antenna elements are used. For example, with reference now to FIG. 5, another embodiment of the present invention is illustrated with a different antenna element 501 to be housed inside of a different sliding assembly 503. As shown in FIG. 5, antenna element 501 is a mono-pole antenna which hinges up into position when in use. When stowed away, antenna element 501 is collapsed, folded down, and recessed fully back into sliding assembly 503.

In still yet some other embodiments, ISM Band Disk antenna elements are used. For example, in the embodiment shown in FIG. 6, antenna element 601 employed is an ISM Band Disk antenna. This antenna element 601 is well known in the art. Similar to an inverted-F antenna element, antenna element 301 has the same toroidal radiation pattern as the mono-/di-pole. In addition, the radiation pattern is shaped more evenly, thereby delivering radiation in an omni-directional pattern. In contrast to FIG. 4's sliding assembly 303, wherein cavity 305 is rectangular, sliding assembly 603 of FIG. 6 has a disk shaped cavity 605.

Sliding Assembly and pc Card

Figure 7A:
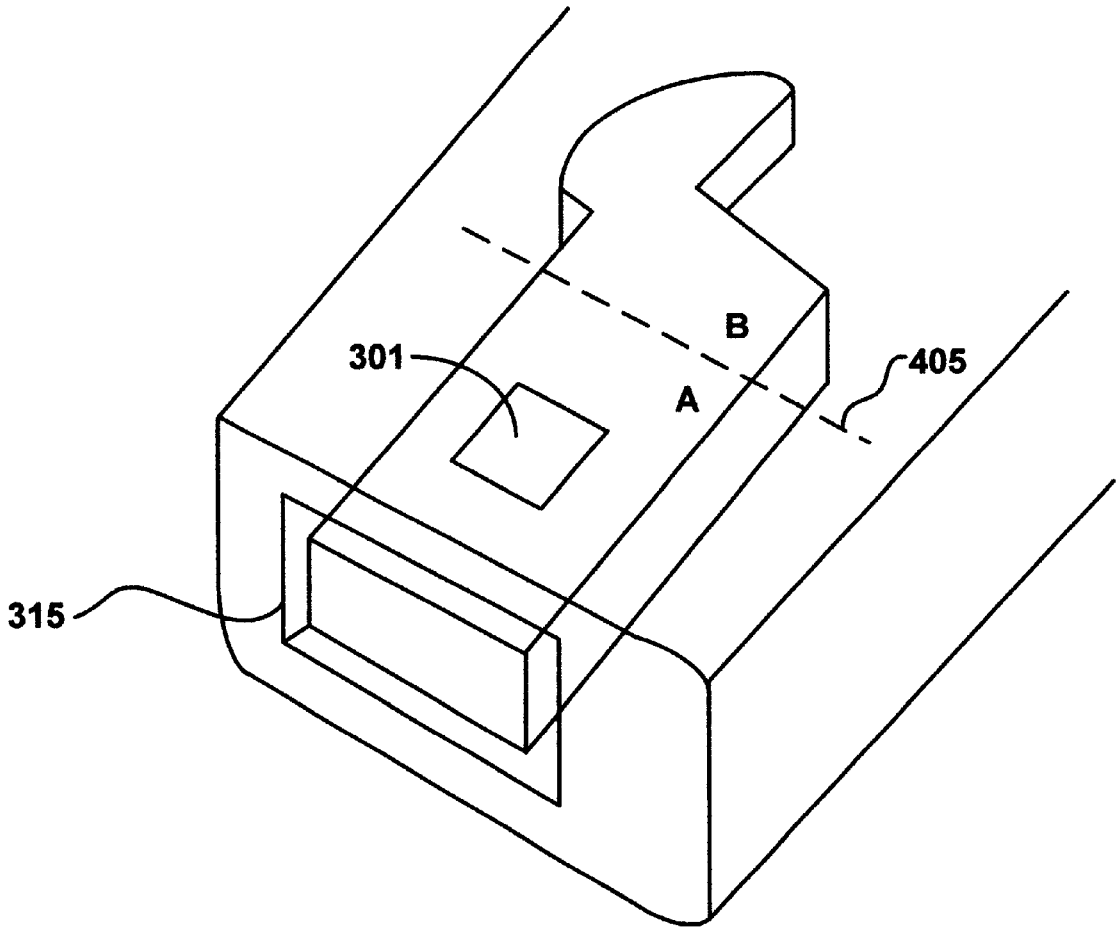
FIG. 7A illustrates one embodiment of a pc card housing a sliding assembly, wherein the sliding assembly is in its retracted position. An antenna element is contained within the sliding assembly.
Figure 7B:
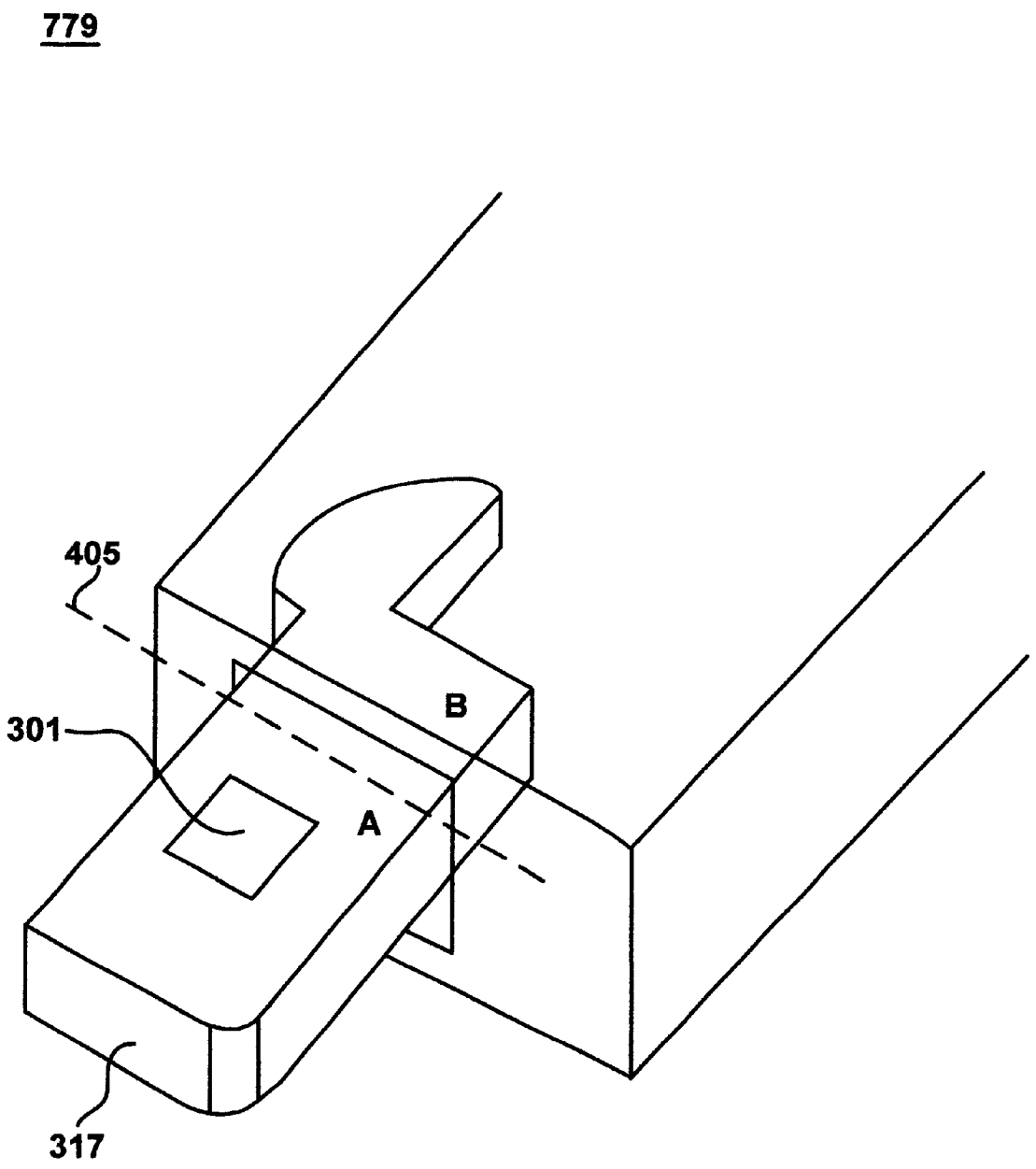
FIG. 7B illustrates one embodiment of a pc card housing a sliding assembly, wherein the sliding assembly is in its protruded position. An antenna element is contained within the sliding assembly.

FIGS. 7A–B focus on two operable positions of sliding assembly 303. In particular, FIG. 7A illustrates retracted position 771 of sliding assembly 303, while FIG. 7B illustrates protruded position 779 of sliding assembly 303. In addition, as depicted in both FIGS. 7A–B, antenna element 301 is already mounted within portion A of sliding assembly 303.

Specifically FIG. 7A focuses in on retracted position 771 of sliding assembly 303. Again, sliding assembly 303 comprises portion A and portion B, wherein portion A contains antenna element 301 and activation surface 317. Except activation surface 317, both portion A and portion B are concealed within pc card 311 when sliding assembly 303 is in retracted position 771. As such, portion A is more accurately described as "mostly concealed" within pc card 311. Moreover, residing within portion A is antenna element 301. Thus, because portion A is mostly concealed within pc card 311, antenna element 301 is also concealed from view.

On the other hand, FIG. 7B focuses in on protruded position 779, which is the alternate operable position of sliding assembly 303. In particular, when activation surface 317 of sliding assembly 303 is momentarily pressed deeper into mouth 315 of pc card 311, sliding assembly 303 is released from its retracted position 771 (as depicted in FIG. 7A) into protruded position 779 depicted in FIG. 7B.

When sliding assembly 303 is in protruded position 779, portion A protrudes from exposing side 313 of pc card 311. More precisely, as depicted in FIG. 7B, portion A is exposed in its entirety while portion B is still concealed within pc card 311. As such, because antenna element 301 is entirely contained within portion A, antenna element 301 is physically located outside of pc card mouth 315 and thereby outside of pc card 311. Moreover, sliding contact 403 located in portion B forms a circuit together with ground plane 401 and antenna element 301.

When antenna element 301 is not in use, sliding assembly 303 is pressed inward manually to return to retracted position 771 as shown in FIG. 7A, wherein activation surface 317 becomes level with plane formed by exposing side 313 and computer side P. In doing so, sliding assembly 303 will stay in retracted position 771 as depicted in FIG. 7A.

Still referring to FIGS. 7A–B, in another embodiment of the present invention, sliding assembly 303 is made of translucent material such as translucent blue plastic. When sliding assembly 303 is in protruded position 779, a light source close to the translucent sliding assembly 303 is activated to illuminate sliding assembly 303. As a result, translucent sliding assembly is illuminated, indicating that wireless communication is in progress.

Importantly, a sliding assembly need not be embedded into a pc card. Furthermore, the two operable sliding positions of a sliding assembly (the retracted position and the protruded position) need not be confined only to an embodiment using a pc card. In some other embodiments, a computer is replaced with a device that has pc card slot to accept a pc card. In yet some other embodiment, pc card is dispensed with entirely. That is, a sliding assembly is housed directly in a device having no pc card slot. Without the intermediate housing by a pc card, the sliding assembly still has two operable positions of retracted position and protruded position relative to the device itself.

For example, in one embodiment, a sliding assembly is embedded directly within a laptop computer without first being housed in a pc card. Hence, in this embodiment, the retracted and protruded positions of a sliding assembly refer to operable positions relative to the laptop computer. In yet another embodiment, a sliding assembly is housed directly within a device that constitutes a node within a wireless network. Hence again, the retracted and protruded positions of sliding assembly refer to operable positions relative to the device.

Also importantly, an antenna element need not be an inverted-F antenna. For example, in one embodiment , a flexible mono-pole antenna element is used. In another embodiment, a rigid mono-pole antenna element is used. In yet another embodiment, an ISM Band Disk antenna element is used.

pc Card and Computer

Figure 8A:
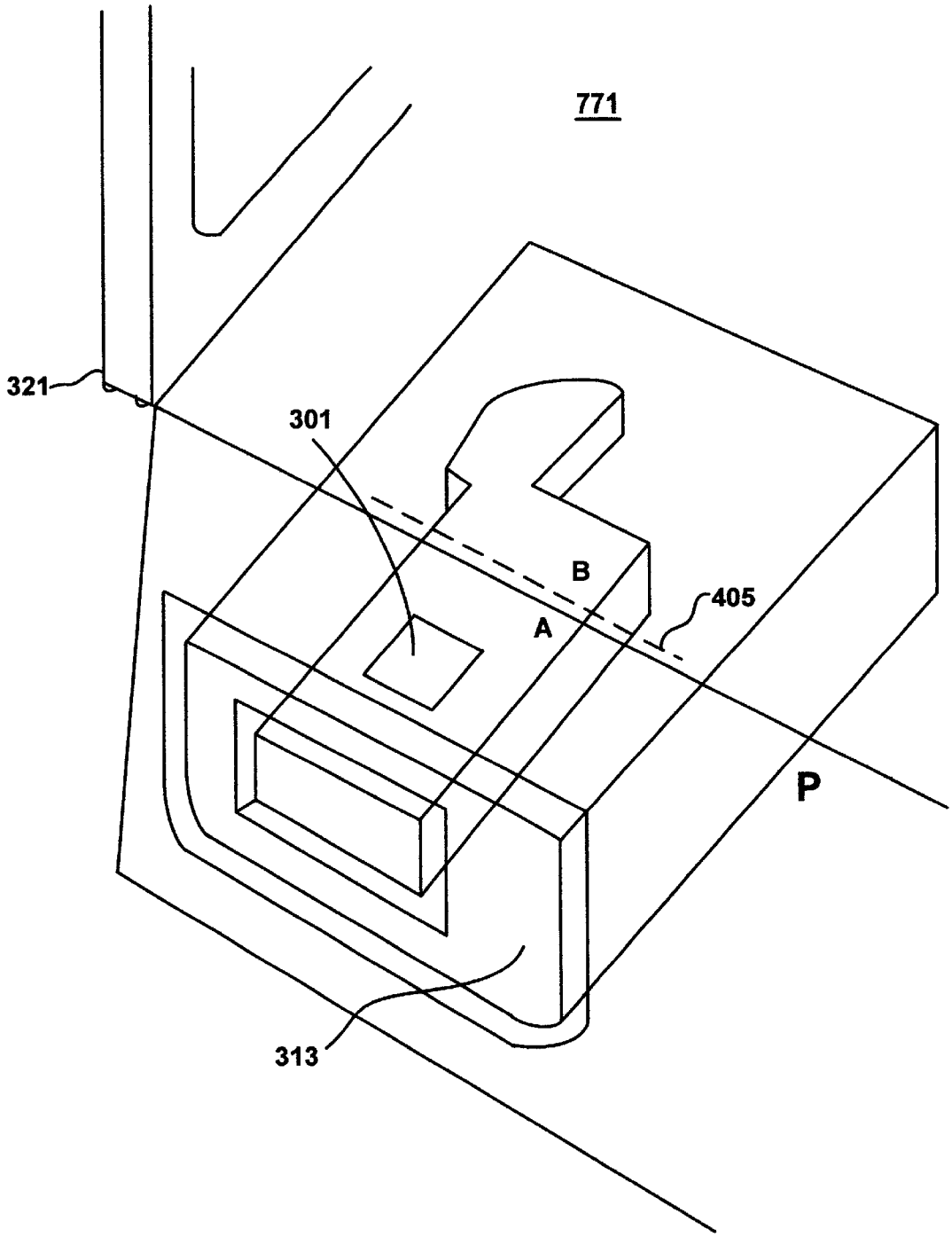
FIG. 8A illustrates one embodiment of a computer into which a pc card is inserted. The pc card houses a sliding assembly in a retracted position. An antenna element contained in the sliding assembly is concealed.
Figure 8B:
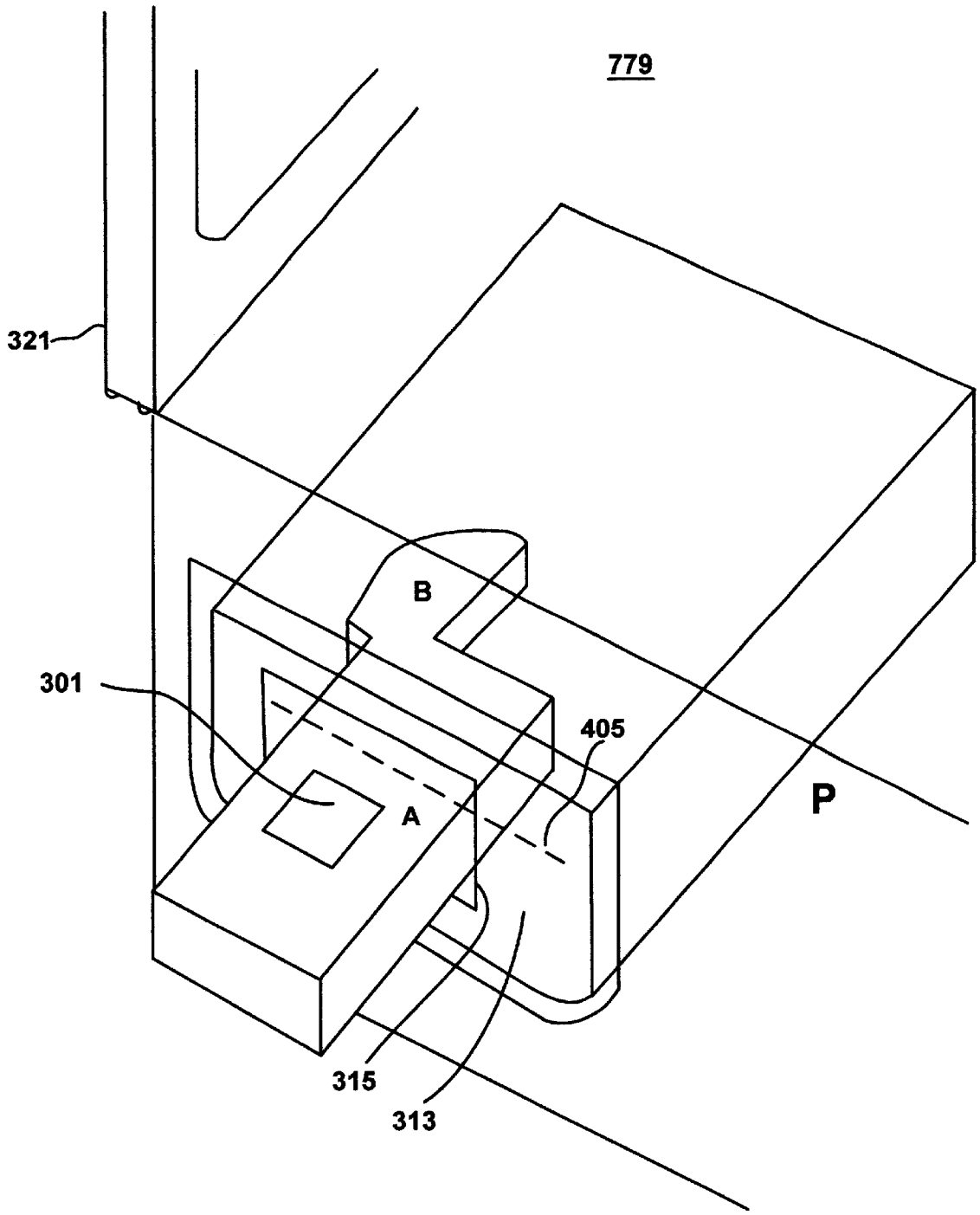
FIG. 8B illustrates one embodiment of a computer into which a pc card is inserted. The pc card houses a sliding assembly in a protruded position. An antenna element is contained within the sliding assembly.

FIGS. 8 A–B illustrate retracted position 771 and protruded position 779 of sliding assembly 303 relative to both pc card 311 and computer 321. As shown in both FIGS. 8A–B, pc card 311 has been inserted into pc card slot 323 of computer 321.

With reference now to FIG. 8A, retracted position 771 of sliding assembly 303 is depicted. In retracted position 779 both portion A and portion B are concealed within pc card slot 323, leaving only exposing side 313 visible and level with side P of computer 321. Because portion A is mostly concealed within pc card 311 (except showing exposing side 313), antenna element 301 contained within portion A is entirely concealed as well. Hence, antenna element 301 does not protrude out of side P of computer 321. As such, in this retracted position 771, computer 321 can be conveniently stored away without antenna element 301 blocking computer 321 from storage.

Furthermore, when sliding assembly 303 in retracted position 771 is slightly pressed inward with respect to mouth 315 of pc card 311, sliding assembly 303 is released from its retracted position 771 into protruded position 779 depicted in FIG. 8B.

As shown in FIG. 8B, protruded position 779 refers to sliding assembly 303 protruding out of mouth 315. Because mouth 315 is leveled with both exposing side 313 (of pc card 311) and side P (of computer 321), sliding assembly 303 protrudes and breaks out of side P. In particular, portion A is entirely exposed outside of pc card 311 and thereby entirely outside computer 321. Because antenna element 301 is contained within portion A o f sliding assembly 303, antenna element 301 is located also entirely outside of computer 321.

In this configuration of FIG. 8B, with sliding assembly 303 in protruded position 779, sliding contact 403 (see FIG. 4) form a circuit with ground plane 401 (see FIG. 4) and antenna element 301. Hence, in this configuration of FIG. 8B, computer 321 is ready to transmit and receive signals to and from a wireless network or a wireless device. In other works, as depicted in FIG. 8B, computer 321 is ready for wireless communication with a wireless network or a wireless device.

When antenna element 301 is not in use while it is in protruded position 779, activation surface 317 of sliding assembly 303 is pressed inward manually such that activation surface 317 becomes level with plane formed by both exposing side 313 and side P. In doing so, sliding assembly 303 returns to and stays in retracted position 771 as depicted in FIG. 8A. In another embodiment, when antenna element 301 is not in use while it is in protrude position 779, activation surface 317 is moved inward automatically such that activation surface 317 becomes level with plane formed by both exposing side 313 and side P. In doing so, sliding assembly 303 returns to and stays in retracted position 771 as depicted in FIG. 8A.

Importantly, a pc card need not be housed only within a computer. For example, in one embodiment of the present invention, a computer is replaced with a device that has pc card slot to accept a pc card.

Also importantly, an antenna element and a sliding assembly need not be used within a pc card in order to function. For example, in one embodiment, an antenna element and a sliding assembly are directly housed in a laptop computer. Thus, a pc card is dispensed with entirely. In another embodiment, an antenna element and sliding assembly are directly housed in a device acting as a part of a node in a wireless network, wherein the device is selectable from a group consisted of pc cards, compact flash cards, Palm devices, PDA's, phones, mobile phones, desktop computers, laptop computers, etc. That is, a sliding assembly is housed directly in a device having no pc card slot. Moreover, the sliding assembly still has two operable positions of retracted position and protruded position relative to the device itself.

In addition, importantly, an antenna element need not be restricted for wirelessly communicating with a wireless network. For example, in one embodiment, an antenna element is used to wirelessly communicate with devices unrelated to network. That is, these devices are not operating as nodes within a network.

Figure 9:
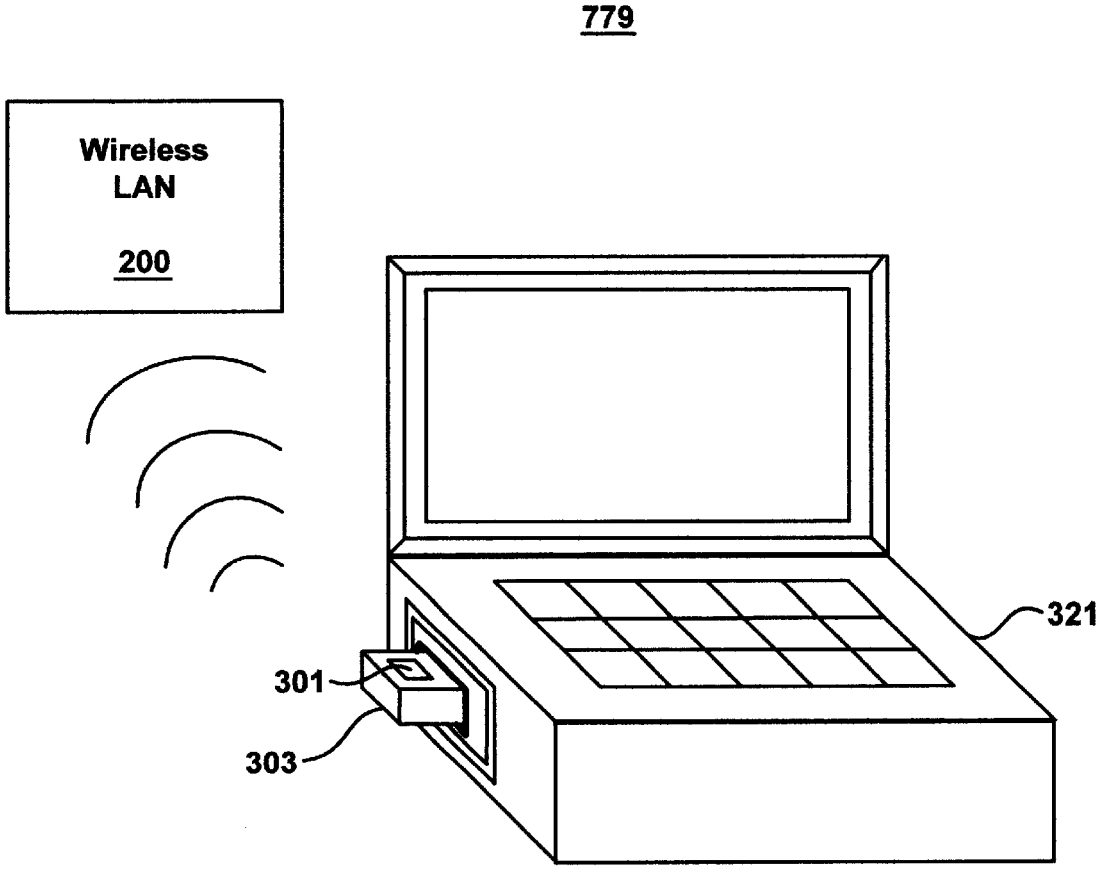
FIG. 9 illustrates one embodiment of the present invention, wherein a computer communicates wirelessly with a wireless LAN. A sliding assembly protruding from a pc card has been inserted into a pc card slot of the computer. The computer in turn communicates wirelessly with a wireless LAN using an antenna element contained within the sliding assembly.

With reference now to FIG. 9, outer view of an embodiment is depicted as communicating wirelessly with a LAN (Local Area Network). as shown, sliding assembly 303 has already been released from retracted position 771 into protruded position 779. In its protruded position 779, sliding assembly 303 protrudes from computer 321. Specifically, sliding assembly 303 protrudes out of side P of computer 321. As such, portion A is fully exposed outside of computer 321 . Also, antenna element 301 in portion A is physically located entirely outside of computer 321. Furthermore, computer 321 is depicted as carrying out wireless communication with wireless LAN 200 through antenna element 301.

As shown in FIG. 9, when wireless communication is in progress, antenna element 301 does not get in the way of keyboard access. Hence, the present invention advantageously enables a computer to wirelessly communicate with a wireless network- without obstructing a user from accessing the computer keyboard. Also, sliding assembly 303 containing antenna element 301 is very robust and sturdy. Computer 321 can be lifted up from sliding assembly 303 in protruded position 779 without causing any damage to computer 321 or sliding assembly 303. Hence, the present invention advantageously enables a computer to wirelessly communicate with a wireless network- without the computer antenna being vulnerable to breakage. Moreover, as discussed before, the present invention advantageously offers an easy way to set up an antenna element. The present invention also advantageously offers a convenient way to store a computer having wireless capability.

Figure 10:
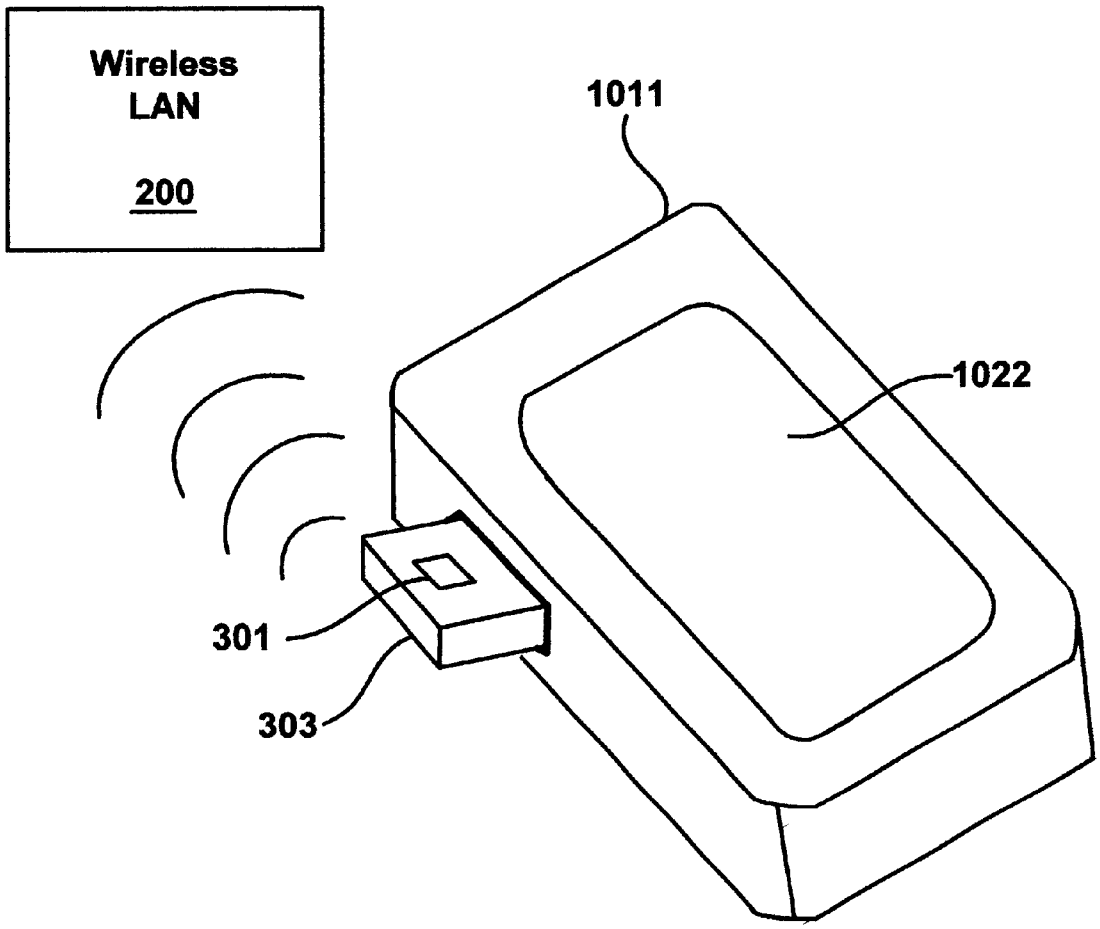
FIG. 10 illustrates one embodiment of the present invention, wherein a device acting as a node communicates wirelessly with a wireless LAN. A sliding assembly protrudes from the device. The device in turn communicates wirelessly with a wireless LAN using an antenna element contained within the device.

FIG. 10 illustrates another embodiment of the present invention. In this embodiment as shown, the computer 321 is replaced with a device 1011 acting as a part of a node of a wireless LAN 200. Device 1011 has a touch screen 1022, but does not have any pc card slot for pc card insertion. Antenna element 301 is embedded in sliding assembly 303. Sliding assembly 303 in turn is directly house within device 1011. Thus, two conspicuous differences of the present embodiment depicted in FIG. 10 from the embodiment depicted in FIG. 9 are the absences of a pc card slot and a pc card.

Importantly, the device is acting as a node for a wireless network, but the device need not be limited to touch screen devices. For example, in some other embodiments, the device is selectable from a group consisted of Palm devices, PDA's, phones, mobile phones, desktop computers and laptop computers. In some other embodiments, the device communicates wirelessly with another wireless device not being part of a network.

With reference still to FIG. 10, when wireless communication is in progress, antenna element 301 does not get in the way of accessing touch screen 1022. Hence, the present invention advantageously enables a device to wirelessly communicate with a wireless network or a wireless device- without obstructing a user from accessing the touch screen 1022. Also, sliding assembly 303 containing antenna element 301 is very robust and sturdy. Device 1011 can be lifted up from sliding assembly 303 in protruded position 779 without causing any damage to device 1011 or sliding assembly 303. Hence, the present invention advantageously enables a device to wirelessly communicate with a wireless network- without the antenna being vulnerable to breakage. Moreover, as discussed before, the present invention advantageously offers an easy way to set up an antenna element. The present invention also advantageously offers a convenient way to store a device having wireless capability.

Figure 11:
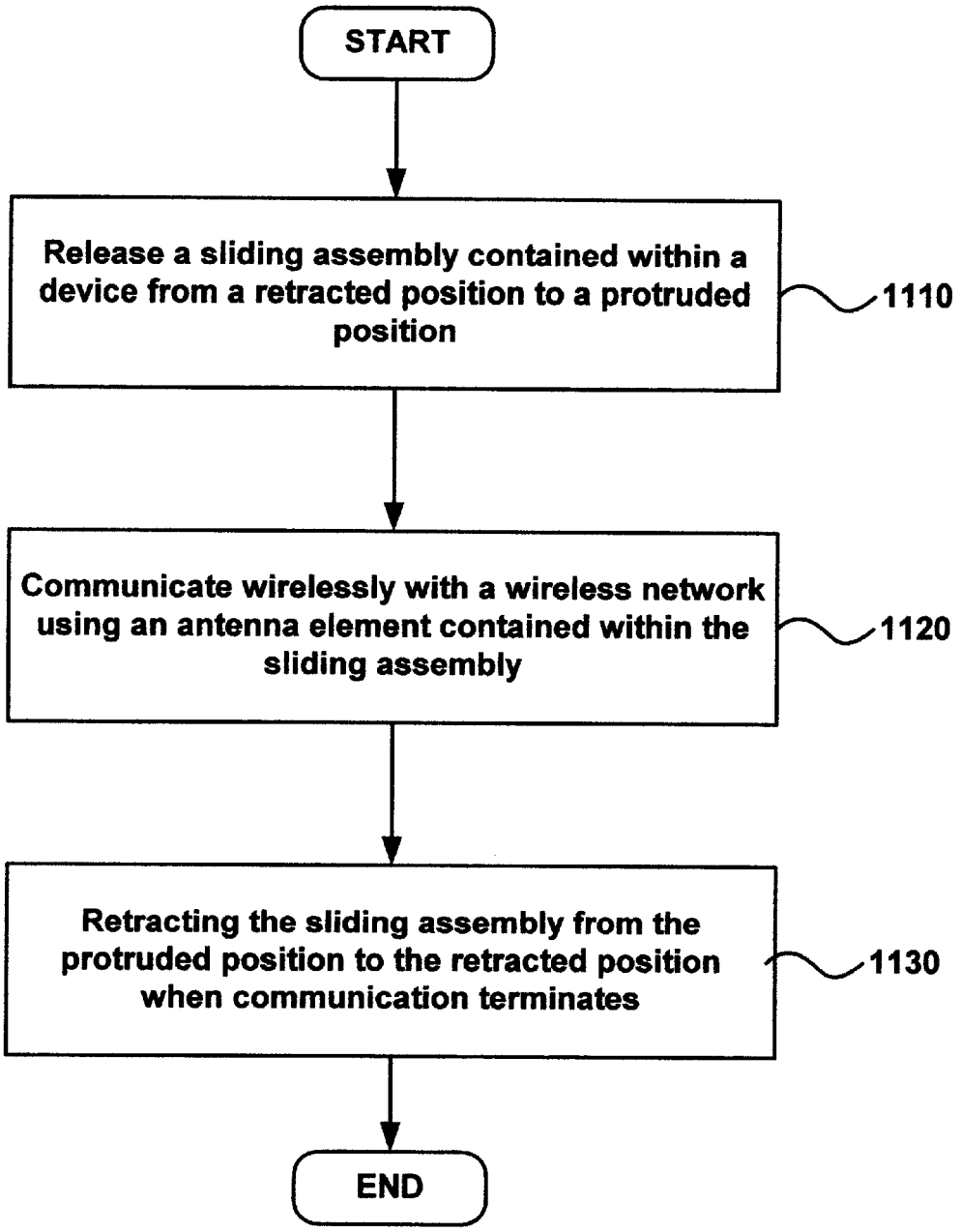
FIG. 11 is a flow chart outlining the steps of one embodiment of the present invention using a device which constitutes a node within a wireless network.

FIG. 11 is a flow chart outlining the steps for using the present invention. First, in step 1110, a sliding assembly in retracted position within a network device is released from the retracted position. In particular, as the sliding assembly is released from the retracted position, the sliding assembly transitions to a protruded position in relation to the device. Moreover, in some embodiments, the device is part of a node for a wireless network. For example, the device is selectable from a group consisted of pc cards, compact flash cards. In some other embodiments, the device is a node for a wireless network. For example, the device is selectable from a group consisted of Palm devices, PDA's, phones, mobile phones, desktop computers and laptop computers.

Next, in step 1120, the device's wireless communication with a wireless network begins. In particular, the device's wireless communication with a wireless network is carried out using an antenna element contained within the sliding assembly. This antenna element is operable when the sliding assembly is in the protruded position.

Finally, in step 1130, when the wireless communication terminates, the sliding assembly is retracted from the protruded position back to the retracted position.

When wireless communication is in progress, the antenna element does not get in the way of accessing the device. Hence, the present invention advantageously enables a device to wirelessly communicate with a wireless network- without obstructing a user from accessing the device. Also, the sliding assembly containing the antenna element is very robust and sturdy. Device can be lifted up from the sliding assembly in protruded position without causing any damage to the device or the sliding assembly. Hence, the present invention advantageously enables a device to wirelessly communicate with a wireless network or a wireless device- without the antenna being vulnerable to breakage. Moreover, as discussed before, the present invention advantageously offers an easy way to set up an antenna element. The present invention also advantageously offers a convenient way to store a device having wireless capability.

Figure 12:
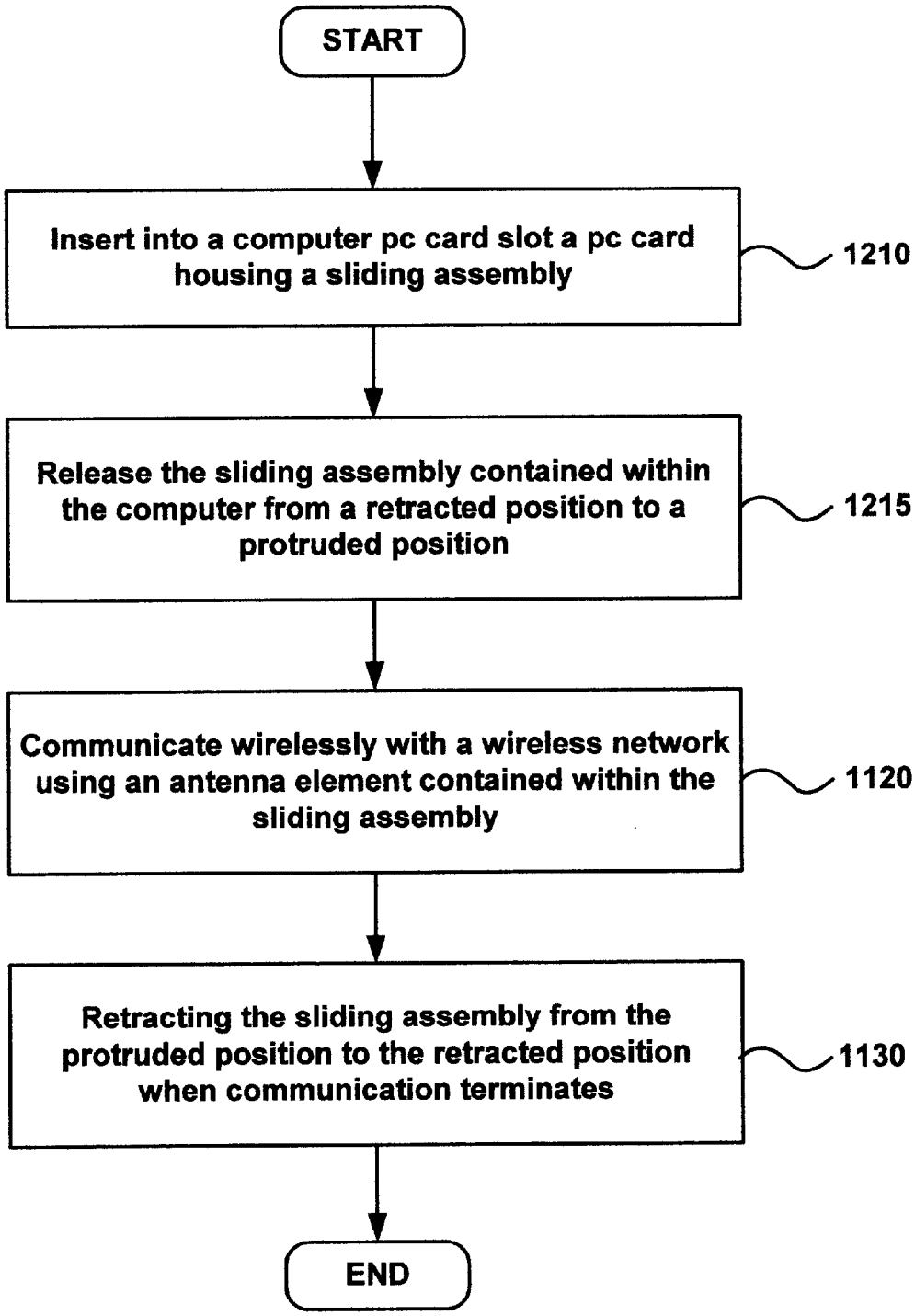
FIG. 12 is a flow chart outlining the steps of one embodiment of the present invention using a computer which constitutes a node within a wireless network.

FIG. 12 is a flow chart outlining the steps for using the present invention. First, in step 1210 a pc card is inserted into a computer pc card slot. This pc card includes an opening to house a sliding assembly. Furthermore, in relation to the pc card, this sliding assembly can slide into a retracted position or a protrude position. When the pc card is inserted into the computer, the sliding assembly in protruded position protrudes from the a side of the computer.

Next, in step 1215, the sliding assembly housed within the pc card is released from the retracted position. In particular, the sliding assembly transitions from the retracted position into a protruded position in relation to both the pc card and the computer.

Furthermore, in step 1120, the computer's wireless communication with a wireless network begins. In particular, the computer's wireless communication with a wireless network is carried out using an antenna element contained within the sliding assembly. This antenna element is operable when the sliding assembly is in the protruded position.

Finally, in step 1130, when the wireless communication terminates, the sliding assembly is retracted from the protruded position back to the retracted position.

When wireless communication is in progress, the antenna element does not get in the way of keyboard access. Hence, the present invention advantageously enables a computer to wirelessly communicate with a wireless network or a wireless device- without obstructing a user from accessing the computer keyboard. Also, the sliding assembly containing the antenna element is very robust and sturdy. The computer can be lifted up from the sliding assembly in the protruded position without causing any damage to the computer or the sliding assembly. Hence, the present invention advantageously enables a computer to wirelessly communicate with a wireless network or a wireless device- without the computer antenna being vulnerable to breakage. Moreover, as discussed before, the present invention advantageously offers an easy way to set up an antenna element. The present invention also advantageously offers a convenient way to store a computer having wireless capability.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and to thereby enable others skilled in the art best to utilize the invention and various embodiments with various modifications as are suited to the particular uses contemplated. It is intended that the scope of the invention be defined by the claims appended hereto and their equivalents.

What is claimed is:

1. An apparatus for enabling wireless communication with a wireless communication system, comprising:

a device adapted to communicate with a wireless communication system;

a sliding assembly contained within said device, wherein said sliding assembly is operable for sliding into a retracted position and sliding into a protruded position, and wherein said sliding assembly has a frontal portion and a rear portion; and an antenna element contained within said frontal portion of said sliding assembly, said antenna element for communicating with said wireless network when said sliding assembly is in said protruded position wherein said sliding assembly is made of translucent material, and wherein said sliding assembly is illuminated in its protruded position to indicate wireless communication in progress.

2. The apparatus of claim 1, wherein said wireless communication system is a wireless network, and wherein said device is operable as a part of a node within said wireless network.

3. The apparatus of claim 1, wherein said device is selectable from a group consisting of pc cards, compact flash cards, Palm devices, PDA's, phones, mobile phones, desktop computers and laptop computers.

4. The apparatus of claim 1, wherein when said sliding assembly is in said retracted position, said sliding assembly is concealed within said device such that only an activation surface of said frontal portion of said sliding assembly is exposed.

5. The apparatus of claim 1, wherein in said protruded position said rear portion of said sliding assembly is concealed within said device, and wherein in said protruded position said frontal portion containing said antenna element protrudes outside of said device.

6. The apparatus of claim 1, wherein said antenna element is selectable from a group consisting of inverted-F antenna, mono-pole antenna, dipole antenna, and Disk antenna.

7. An apparatus for enabling a computer to communicate with a wireless communication system, comprising:

a pc card configured for insertion into a computer pc card slot;

a sliding assembly contained within said PC card, wherein said sliding assembly is operable for sliding into a retracted position and sliding into a protruded position, and wherein said sliding assembly has a frontal portion and a rear portion; and an antenna element contained within said frontal portion of said sliding assembly, said antenna element for communicating with a wireless communication system when said sliding assembly is in said protruded position, wherein said sliding assembly is made of translucent material, and wherein said sliding assembly is illuminated in its protruded position to indicate wireless communication in progress.

8. The apparatus of claim 7, wherein said wireless communication system is a wireless network, and wherein said pc card is operable as a part of a node for said wireless network.

9. The apparatus of claim 7, wherein said pc card is a type II pc card.

10. The apparatus of claim 7, wherein in said retracted position said sliding assembly is concealed within said device such that only an activation surface of said frontal portion of said sliding assembly is exposed.

11. The apparatus of claim 7, wherein in said protruded position said rear portion of said sliding assembly is concealed within said computer, and wherein in said protruded position said frontal portion containing said antenna element protrudes outside of said computer.

12. The apparatus of claim 7, wherein said antenna element is selectable from a group consisting of inverted-F antenna, mono-pole antenna, dipole antenna, and Disk antenna.

13. A method for enabling wireless communication with a wireless communication system, said method comprising the steps of:

a) releasing a sliding assembly contained within a device from a retracted position for transitioning to a protruded position, wherein said device is adapted for communicating with a wireless communication system;

b) communicating wirelessly with said wireless communication system using an antenna element contained within said sliding assembly, wherein said antenna element is operable when said sliding assembly is in said protruded position, and wherein said sliding assembly is made of translucent material, and wherein said sliding assembly is illuminated in its protruded position to indicate wireless communication in progress; and c) retracting said sliding assembly from said protruded position to said retracted position when said communicating step b) terminates.

14. The method of claim 13, wherein said wireless communication system is a wireless network.

15. The method of claim 13, wherein said step a) further comprises the step of:

activating an activation surface on a frontal portion of said sliding assembly to begin said transitioning from said retracted position to said protruded position, wherein said antenna element is within said frontal portion.

16. The method of claim 13, wherein said step b) further comprises the step of:

commencing wireless communication programs for using said antenna element with said device.

17. The method of claim 13, wherein said step b) further comprises the step of:

commencing wireless networking programs for using said antenna element with said device.

18. The method of claim 13, wherein said device is selectable from a group consisting of pc cards, compact flash cards, Palm devices, PDA's, phones, mobile phones, desktop computers and laptop computers.

19. The method of claim 13, wherein in said retracted position said sliding assembly is concealed within said device such that only an activation surface on a frontal portion of said sliding assembly is exposed, wherein said antenna element is contained within said frontal portion.

20. The method of claim 13, wherein in said protruded position a rear portion of said sliding assembly is concealed within said device, and wherein in said protruded position a frontal portion containing said antenna element protrudes outside of said device.

21. The method of claim 13, wherein said antenna element is selectable from a group consisting of inverted-F antenna, mono-pole antenna, dipole antenna, and Disk antenna.

* * * * *